US012751508B2

(12) United States Patent
Zoll

(10) Patent No.: US 12,751,508 B2
(45) Date of Patent: Oct. 6, 2026

(54) GARMENT HAVING AN ENHANCED PLAY FUNCTION AND PLAY LANDSCAPE

(71) Applicant: Ines Zoll, Sigmaringen (DE)

(72) Inventor: Ines Zoll, Sigmaringen (DE)

( * ) Notice: Subject to any disclaimer, the term of this patent is extended or adjusted under 35 U.S.C. 154(b) by 228 days.

(21) Appl. No.: 18/647,312

(22) Filed: Apr. 26, 2024

(65) Prior Publication Data

US 2024/0268496 A1 Aug. 15, 2024

Related U.S. Application Data

(63) Continuation-in-part of application No. 17/445,509, filed on Aug. 20, 2021, now abandoned, which is a (Continued)

(30) Foreign Application Priority Data

Feb. 26, 2019 (DE) ..... 10 2019 104 896.6

(51) Int. Cl.
*A41D 27/08* (2006.01)
*A41D 11/00* (2006.01)

(Continued)

(52) U.S. Cl.
CPC ..... *A41D 27/08* (2013.01); *A41D 11/00* (2013.01); *A63H 3/003* (2013.01); *A63H 33/26* (2013.01)

(58) Field of Classification Search
CPC ..... A41D 11/00; A41D 27/08; A41F 1/002; A44D 2203/00; A63F 2009/0023;

(Continued)

(56) References Cited

U.S. PATENT DOCUMENTS 2,628,452 A * 2/1953 Beulah ..... A63H 3/52 446/28
3,724,101 A * 4/1973 Slezak ..... G09B 17/00 40/586

(Continued)

FOREIGN PATENT DOCUMENTS

CN 101427852 A * 5/2009 ..... A41D 27/08
FR 2 786 669 A1 6/2000
KR 100834997 B1 5/2008

OTHER PUBLICATIONS

German Office Action (Application No. 10 2019 104 896.6) dated Sep. 29, 2019.

(Continued)

*Primary Examiner* — Alexander R Niconovich
(74) *Attorney, Agent, or Firm* — Muncy, Geissler, Olds & Lowe, P.C.

(57) ABSTRACT

A garment, in particular an outer garment having a play surface with an enhanced play function, wherein a play figure and a movable fastening device are provided, wherein the movable fastening device is connected to the garment and/or integrated in the garment, wherein the movable fastening device is partially movable relative to the garment and/or to the play surface and/or has a moving element that is movable relative to the garment and/or to the play surface, and the play figure is detachably fastened to the movable fastening device and/or to the moving element.

23 Claims, 10 Drawing Sheets

Related U.S. Application Data continuation of application No. PCT/EP2020/055068, filed on Feb. 26, 2020.

(51) Int. Cl.
*A63H 3/00* (2006.01)
*A63H 33/26* (2006.01)

(58) Field of Classification Search
CPC ..... A63F 9/001; A63H 3/003; A63H 3/26; A63H 33/26
USPC ..... 2/75, 80, 244, 250, 69; 446/26, 28; 434/395
See application file for complete search history.

(56) References Cited

U.S. PATENT DOCUMENTS 4,466,136 A * 8/1984 Bottom ..... A41D 27/08 40/586
4,710,979 A * 12/1987 Bull ..... A41B 13/10 2/48
4,723,323 A * 2/1988 Wright, Jr. ..... G09B 19/0076 2/244
4,860,387 A * 8/1989 Williams ..... A41D 27/08 2/244
4,975,987 A * 12/1990 Teachout ..... A41D 27/08 2/244
5,210,881 A * 5/1993 Stocker, Jr. ..... A41D 27/20 2/244
5,394,565 A * 3/1995 Stewart ..... A41D 11/00 446/28
5,542,122 A * 8/1996 Moldovan ..... A41D 27/08 2/244
5,742,939 A * 4/1998 Williams ..... A41D 13/015 446/28
5,901,372 A * 5/1999 Lawler ..... A41D 27/08 2/69
5,933,866 A * 8/1999 Fox ..... A41D 27/08 2/244
6,224,450 B1 * 5/2001 Norton ..... B62J 1/16 446/28
6,332,862 B1 * 12/2001 Zandman ..... A41C 3/00 600/38
6,397,390 B1 * 6/2002 Henderson ..... A41D 27/08 40/586
6,663,393 B1 * 12/2003 Ghaly ..... A63H 29/22 434/262
6,769,139 B1 * 8/2004 Goldkind ..... A41D 27/20 2/247
6,769,588 B2 * 8/2004 Zheng ..... A45F 4/02 190/111
6,954,968 B1 * 10/2005 Sitbon ..... A43C 11/00 2/269
6,966,472 B2 * 11/2005 Szarek ..... A63H 33/006 446/28
6,982,115 B2 * 1/2006 Poulos ..... B44C 1/10 428/206
7,140,047 B2 * 11/2006 Kronenberger ..... A42B 1/24 2/209.13
7,146,651 B1 * 12/2006 Lapin ..... A41D 19/01594 2/338
7,296,999 B2 * 11/2007 Webber ..... G09B 19/00 434/168
7,434,271 B2 * 10/2008 Klayman-Grodsky ..... A41D 15/04 2/244
7,491,108 B2 * 2/2009 Ghaly ..... A63H 33/26 446/175
7,914,290 B2 * 3/2011 Yoon ..... A41D 27/08 434/260
7,987,522 B2 * 8/2011 Morgan ..... F41H 3/00 2/244
9,089,169 B1 * 7/2015 Covo ..... A41D 1/04
9,877,527 B1 * 1/2018 Marshall ..... A41D 27/08
10,111,471 B2 * 10/2018 Madine ..... A41B 9/06
2004/0068778 A1 * 4/2004 Van Veghel ..... A41D 27/08 2/244
2004/0077265 A1 * 4/2004 Ghaly ..... A63H 33/26 446/175
2005/0278821 A1 12/2005 Klayman-Grodsky
2007/0151084 A1 7/2007 Long
2009/0038205 A1 * 2/2009 Stroud ..... B63B 32/40 63/3
2009/0126071 A1 * 5/2009 Salvanto ..... A41B 13/00 2/243.1
2010/0058510 A1 * 3/2010 Vithlani ..... A41D 27/08 2/244
2010/0167619 A1 * 7/2010 Adamus ..... A41D 27/08 446/72
2010/0269239 A1 * 10/2010 Kulp ..... A41D 27/08 2/244
2011/0254225 A1 10/2011 Doherty
2011/0283438 A1 * 11/2011 Davis ..... A63H 3/003 2/163
2011/0307994 A1 * 12/2011 Woloschuk ..... A41D 27/08 2/102
2012/0047630 A1 3/2012 Gare
2012/0329357 A1 * 12/2012 Brodess ..... A41D 20/00 446/26
2013/0091620 A1 * 4/2013 Randolph ..... A43B 3/242 2/244
2013/0125286 A1 * 5/2013 Roberts ..... A41D 27/08 2/69
2013/0298300 A1 11/2013 Schaeper
2014/0047613 A1 * 2/2014 Henderson ..... A63F 9/001 463/48
2014/0082817 A1 * 3/2014 Kempe ..... A45F 5/02 2/244
2015/0047105 A1 2/2015 Fonzo
2015/0101096 A1 * 4/2015 Turner ..... A41D 1/06 2/455
2015/0298896 A1 10/2015 McCullagh
2016/0015101 A1 1/2016 Stefanovic
2017/0303599 A1 10/2017 Madine
2018/0146729 A1 * 5/2018 Helferstay ..... A41D 27/08
2019/0173301 A1 * 6/2019 Narayanasamy ..... H02J 7/855
2020/0282301 A1 * 9/2020 Harris ..... A63F 11/0011
2020/0288799 A1 9/2020 Andrews
2021/0392979 A1 * 12/2021 Zoll ..... A41F 1/002

OTHER PUBLICATIONS

International Search Report and Written Opinion (Application No. PCT/EP2020/055068) dated Jun. 9, 2020.
German Examination Report (Application No. 10 2019 104 896.6) dated Aug. 18, 2021.
English translation of the International Preliminary Report on Patentability (Chapter I) dated Sep. 10, 2021 (Application No. PCT/EP2020/055068).
Chinese Office Action dated Dec. 20, 2022 (Application No. 202080016774.7).

* cited by examiner

GARMENT HAVING AN ENHANCED PLAY FUNCTION AND PLAY LANDSCAPE

CROSS REFERENCE TO RELATED APPLICATIONS

This application is a continuation-in-part of U.S. patent application Ser. No. 17/445,509, filed Aug. 20, 2021, which is a continuation of International Application No. PCT/EP2020/055068 filed Feb. 26, 2020, which designated the United States, and claims the benefit under 35 USC § 119(a)-(d) of German Application No. 10 2019 104 896.6 filed Feb. 26, 2019, the entireties of which are incorporated herein by reference.

FIELD OF THE INVENTION

The present invention relates to a garment having an enhanced play function and a play landscape.

BACKGROUND OF THE INVENTION

Garments for children that are designed to stimulate and foster the imagination for play are widely known from the prior art. For example, US 2018/0146729 A1 discloses a garment, for instance in the form of a T-shirt, on which the natural habitat of various animals (for example, a forest) is depicted and can also be tangibly integrated in the garment in that, for example, pockets in the form of caves are attached. Furthermore, it is accordingly possible to accommodate animals that belong in the habitat in the pockets or, for example, also to fix them to the garment by way of hook-and-loop fasteners or the like.

Moreover, KR 10 0 834 997 B1 discloses a garment to which a kind of clothesline is fastened by buttons, toy garments being able to be hung in turn on hangers fixed to the clothesline.

SUMMARY OF THE INVENTION

Against this background, it is an object of the present invention to propose a garment that is equipped with an enhanced play functionality and furthermore makes it easier for parents and children on the move to transport toys.

Accordingly, the garment according to the present invention is noteworthy in that a play figure and a movable fastening device are provided, wherein first of all the movable fastening device is connected (in particular, permanently or detachably) to the garment and/or is integrated in the garment. In contrast to the prior art, the garment according to the invention thus has especially the special feature that the corresponding play figure or the play figures can be fastened detachably to the movable fastening device and is/are not just fixed purely statically to the garment, as has hitherto been conventional in the prior art. In contrast to the prior art, this makes a dynamic play activity possible in the first place, in which the clothing is incorporated and arouses particular interest even for children as a result of its increased functionality. The movable fastening device can itself be configured in a movable manner in that the entire fastening device or a part of it is attached or mounted such that there it has a degree of freedom of movement. The movable fastening device also has a fixed part, however, and additionally comprises a moving element that is mounted accordingly in a movable manner. The movable fastening device or the moving element can then be movable relative to the garment or the play surface, and is movable as a rule not just in a plane parallel to the play surface but in a three-dimensional region.

In contrast to the prior art, the garment is thus incorporated directly into play, to be more precise into a three-dimensional play activity. Specifically, if the play figure is merely fastened to the garment and is statically fixed thereto, the actual play process is only allowed in that the play figure is detached from the garment itself and is moved in space. According to the present invention, the garment is assigned a play landscape, however, which not only consists in the provision of a surface that can optionally also bear a motif but also in the play surface of the garment according to the present invention becoming a part of the play space used when playing. At the same time, the garment is given an enhanced play function, i.e. it becomes a part of the actual toy or game as a result of the structural features according to the present invention and does not just have the passive function of being merely a backdrop. Moreover, it is possible, as a result of the present invention, to dispense with carrying along additional toys such as dollhouses or the like when on the move/on the road, since the garment is capable of taking on this play function in its entirety.

The respective play figure is, according to the present invention, fastened magnetically to the movable fastening device or the moving element. The fastening can additionally also be configured in some other way depending on the exemplary embodiment, for example, by clamping or by a hook-and-loop fastener. In addition, this does not preclude play figures that are fastened in some other way from being present in addition to a magnetically fastenable play figure.

Various ones of these fastening variants may also be used together in the scope of the garment and be integrated therein. It is also conceivable to effect a type of coding in that, for example, different movable fastening devices or the moving elements thereof are provided and only individual ones of these fastening devices or moving elements are assigned to each animal. For example, among the play figures, it is possible for only the monkeys to stick to a movable fastening device or a moving element in the form of a liana, but not the lion play figure.

For detachable fastening, it is possible to use clamping mounts, magnetic fasteners or hook-and-loop fasteners, which can be found as standard fastening elements for such garments among sewing equipment.

The movable fastening device and/or the moving element can be configured as follows: for example, it can be a kind of pendulum, which represents for instance a liana. Such a pendulum can be fastened to the play surface at at least one point, along a part of its length or along its entire length.

Together with the use of magnets as means for detachable fastening, a further play option is realized according to the present invention in that a kind of pocket is integrated into the garment, a magnet or magnetizable body being introduced into the interior space of the pocket so as to be mounted in a movable manner within the pocket. As a magnet or magnetizable body, it is then possible to use, for example, a flat body, for instance in the form of a small plate, especially with rounded edges. The body can, therefore, be configured in a flat manner so that the garment is only slightly thicker toward the outside than the rest of the garment, if at all, in the region where it is currently mounted within the pocket. The smaller the body, the more unobtrusively it is accommodated within the garment. Furthermore, the body also has more freedom of movement within the pocket, the smaller it is designed to be. Rather than a magnet, the body can also comprise a ferromagnetic material. The choice of material depends on whether, for example, a play figure that is intended to be detachably fastened thereto likewise has a magnet or only a magnetizable material. Furthermore, it is also conceivable, on account of the orientation of two magnets that are used (for instance in the play figure and on the fastening device or on the moving element), to exploit repulsion effects such that only particular orientations are allowed during attachment.

The type of movement can be realized in various ways. A further variant consists for instance in providing a guide rail with a runner, mounted in the guide rail, as moving element. A band, string or cord can be used, for example, as guide rail, wherein the magnet or the magnetizable body is pulled onto the guide rail, for example, as a running bead. It is also conceivable for the magnet or magnetizable body to be mounted as moving element in a guide rail that is in the form of a hose, tunnel or pipe, such that it can likewise move along the length thereof. Advantageously, the garment can thus be adapted to different play situations and, depending on desire, provide a separate world of play in that different movement possibilities are also imitable (for example, swinging on lianas, sliding movements, etc.). As a result of it being possible to join play figures to the garment, or to join the movable fastening device to the garment, these nevertheless form a unit and can also be transported in a connected manner on the body.

In a particularly preferred exemplary embodiment, the pocket is integrated as inconspicuously as possible as a movable fastening device into the garment, such that it is not perceived to exist at all from the outside. Thus, the pocket can extend substantially parallel to the play surface, i.e. for example, be accommodated in the layer of material or in a plane parallel to the layer of material. The extension perpendicular to the play surface can be chosen to be as small as possible in order that the material or the garment does not attract attention in this region on account of an increased thickness.

In a further exemplary embodiment, the interior space of the pocket can in principle be completely closed. In order for it to be possible to wash the garment, however, it is advantageous for it to be possible to remove the magnet or the magnetizable body before washing. In this regard, in such an embodiment, the interior space can be configured to be openable and reclosable in a subregion, in particular, in a subregion of the periphery. The moving element (magnet or magnetizable body) can then be reintroduced into the interior space after washing. In particular when the moving element is made of metal, corrosion of the moving element, which results in the function being restricted but also in the garment being soiled, can be avoided.

Depending on the play situation and the play surface, the pocket can be shaped in different ways. In particular, it can be in the form of a tunnel, the width of which parallel to the play surface corresponds to that of the moving element, such that the moving element is mounted in the tunnel so as to be movable only along the length of the tunnel. Such a tunnel corresponds in principle to a guide rail, at least as regards the movement possibility. It is also conceivable for it to be in the form of a labyrinth.

Furthermore, a combination of the garment with static fastening mechanisms are also possible, for example, with hook-and-loop fasteners, press buttons, but also with magnets or magnetizable bodies. In the case of the static fastening mechanisms, the play figure can be attached only at the point that is provided therefor and at which the fastening mechanism is located, without being shifted relative to the garment. Lastly, a different design possibility consists in a plurality of static fastening mechanisms being attached sequentially such that the play figure can be moved like on a path from point to point and thus from one static fastening mechanism to the next in that it is in each case detached and reattached, but is not moved fluently.

In different embodiments of the present invention, different implementations of the pocket are also possible. One possibility is to attach a further piece of textile on the play surface or beneath the play surface. Furthermore, it is conceivable to manufacture the garment from a double layer of material and to form the pocket between these two layers of material. In the peripheral regions that are intended to bound the subsequent pocket, the two layers can be joined together such that the moving element, too, still has to be located in the interior space thus formed.

The manner in which the pocket specifically is formed also depends on the type of garment. Some garments, in particular, winter clothing, functional clothing or the like, are intrinsically already conceived of as multilayer garments, and so this property can be used accordingly for incorporating the pocket.

A particularly advantageous expansion of the play possibilities is proposed by the play device according to the present invention for children to play with, which initially has the garment according to the present invention or a garment according to one of the abovementioned exemplary embodiments, but additionally also comprises a tool such as a rod, which has a magnet or a magnetizable body, wherein at least one play figure is present, which in turn likewise comprises a magnet or a magnetizable body, such that the play figure can be moved with the rod. In this development, the moving element takes on a life of its own to a certain extent and thus affords a particular expansion of the play possibilities, since the movement possibilities over the play surface are no longer restricted. At the same time, as a result of the magnetic holding force, the rod can also be fastened to the garment, wherein the garment can, in particular, also be trapped between the rod and play figure, such that the rod can also be readily carried along on the body and transported as part of an entire play device.

According to the present invention, the pocket extends to cover at least 5%, preferably at least 10%, of the play surface. The movable, non-fixed magnet or magnetizable body (moving element) inside the pocket is much smaller than the pocket. It can move along the play surface over a distance of at least two times its diameter (if it is a circular body) or its maximum dimension (length or width). It is therefore different from a magnet or a magnetizable body that is used only to hold an object at a fixed place where the pocket is only slightly larger than the object, since the object could otherwise not be inserted into the pocket when the garment is manufactured.

However, another non-movable magnet or magnetizable body can be at a fixed position on/in the play figure, in most cases in the upper part of the play figure. For a relative movement of the play figure with regard to the play surface, only it is only necessary to be able to move the (movable) magnet or magnetizable body (moving element) that is inside the pocket. The dimensions of play figure are usually smaller than the size of the play surface. The non-movable magnet or magnetizable body can be located in the extremities of the play figure, for example, at the end of the arms, legs, or in the head, so that it can be easily attached.

For the movement, the pocket forms a two dimensional surface that extends over a certain length and width of the play surface of the garment. The pocket can have any shape/form: rectangular, squared, round/circular, triangular or any irregular shape. However, with an advantageous embodiment, the length and width of the pocket should be at least two times the extent (maximum dimension) of the movable magnet or the magnetizable body (moving element), so that it can be moved a distance that is at least equal to the extent of the movable magnet/magnetizable body. In many cases, a circular magnet or magnetizable body would be preferred. Such a form can be easily fabricated and can also slide easily inside the pocket, since it cannot get caught up because it has no corners. It is advantages to choose the dimensions of the pocket to be much bigger than the dimensions of the magnet/magnetizable body.

The garment, in most cases, can be used as a children's toy. Therefore, it could be a risk if the pocket could be opened so that the movable magnet or the magnetizable body be removed, because it could be swallowed by children. This should be avoided. On the other hand, the garment needs to be washed from time to time. If the movable magnet or magnetizable body cannot be removed, it shall be washed together with the garment. Hence the movable magnet or magnetizable body must not be corroded and/or start to rust. This can be avoided if the movable magnet or magnetizable body is made from an inert material, such as a magnetizable stainless steel or the like. Furthermore, it is possible, especially if the movable magnet/magnetizable body cannot be made of an inert material, to coat it with a waterproof coating, in particular with a chemically inert coating, so that the movable magnet/magnetizable body is not susceptible to corrosion in the short and long run. This is also advantageous, since the rust could otherwise discolor the fabric.

Since children should not be able to get the movable magnet/magnetizable body out of the pocket, the pocket can be tightly closed along its edge, for example sewn up, glued, welded or studded along its entire contour (outer periphery).

With a chemically inert surface of the magnet/magnetizable body or a waterproof, inert coating it is also possible to wash the garment using a washing machine.

The pocket can also form a part of the edge of the play surface, in particular, at the front side of the garment. The pocket can form the contour of the garment and the seam of the garment can be used to close the pocket at least in part.

A significant advantage of the present invention is that, according to one embodiment, the system of the play figure in contact with the fabric and the movable magnet (or movable magnetizable body) inside the pocket can stick together due to the magnetic force and can stay at this position due to friction between the play figure, the fabric and the movable magnet or magnetizable body. In a preferred embodiment, it is also possible to move the play figure manually and the movable magnet can follow. When you stop moving the play figure and the movable magnet has followed to that position, the play figure is again attached at that point. Hence a maximum of flexibility is provided with such a configuration. The play figure can be attached at any point where the movable magnet or magnetizable body (moving element) can also be moved.

There can also be provided, in general, a movable magnet inside the pocket and a fixed, non-movable magnet inside the play figure. Since unlike magnetic poles attract each other, whereas like poles repel each other, the play figure can only be attached in a pre-defined orientation or the movable magnet has to turn inside the pocket. Any magnetizable body may adapt its magnetization, when the magnet is near and its magnetic field affects it.

BRIEF DESCRIPTION OF THE DRAWINGS

Exemplary embodiments of the present invention are illustrated in the drawings and explained in more detail in the following text with further details and advantages being specified.

DETAILED DESCRIPTION OF THE INVENTION

Figure 1:
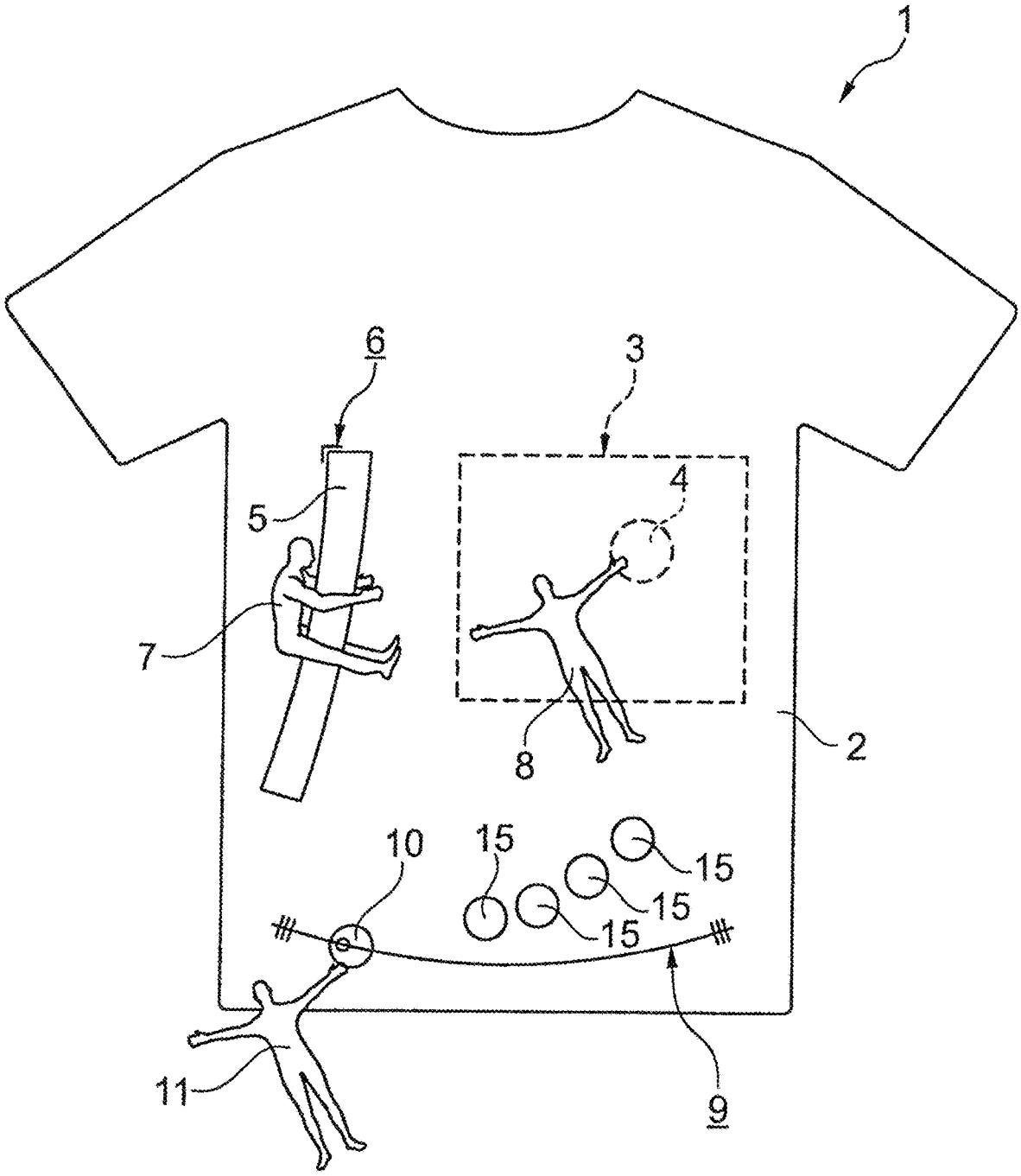
FIG. 1 shows a schematic illustration of a garment according to the present invention.

FIG. 1 shows a garment 1 according to the present invention, in this case in the form of a T-shirt, in which the front side is in the form of a play surface 2. Provided on the play surface 2 are 3 movable fastening devices, namely a pocket 3, which is not itself movable but has a moving element 4 in the form of a small magnetic plate that is located in turn in the interior space of the pocket 3. Furthermore, a pendulum 5 that serves as a liana is provided, which in this case is fastened detachably via a hook-and-loop fastener 6 to the play surface 2. Stuck in turn to the moving element 5 is a play FIG. 7. This play FIG. 7 has magnets or magnetizable metal bodies incorporated in its extremities, such that the two arms or front feet can be stuck together. In this way, the play FIG. 7 can in turn be attached in a retained manner to the moving element 5, which is present in the form of a pendulum. A similar play figure 8 is also provided in the region of the pocket 3 and hangs detachably there on the moving element 4, which is in turn located in the interior space of the pocket 3 and is not visible from the outside. The play FIG. 7 can be moved in a manner hanging on the pendulum 5 while the play figure 8 can be guided over the surface that is defined by the pocket 3 and makes up a part of the play surface 2.

Located furthermore in the lower region of the garment 1 is a guide rail 9, which is permanently fastened (sewn in) to the play surface 2 in each case in its end regions. Threaded onto the guide rail 9 is a bead made of a magnetizable body 10. From this bead 10, which likewise represents a moving element, there in turn hangs a play FIG. 11, into one arm of which a magnet is integrated such that it can be fastened detachably to the bead 10.

A plurality of static fastening mechanisms 15 in the form of hook-and-loop fasteners form a path, along which a play figure can be guided, or to which it can be fastened, with hook-and-loop fasteners.

Figure 2:
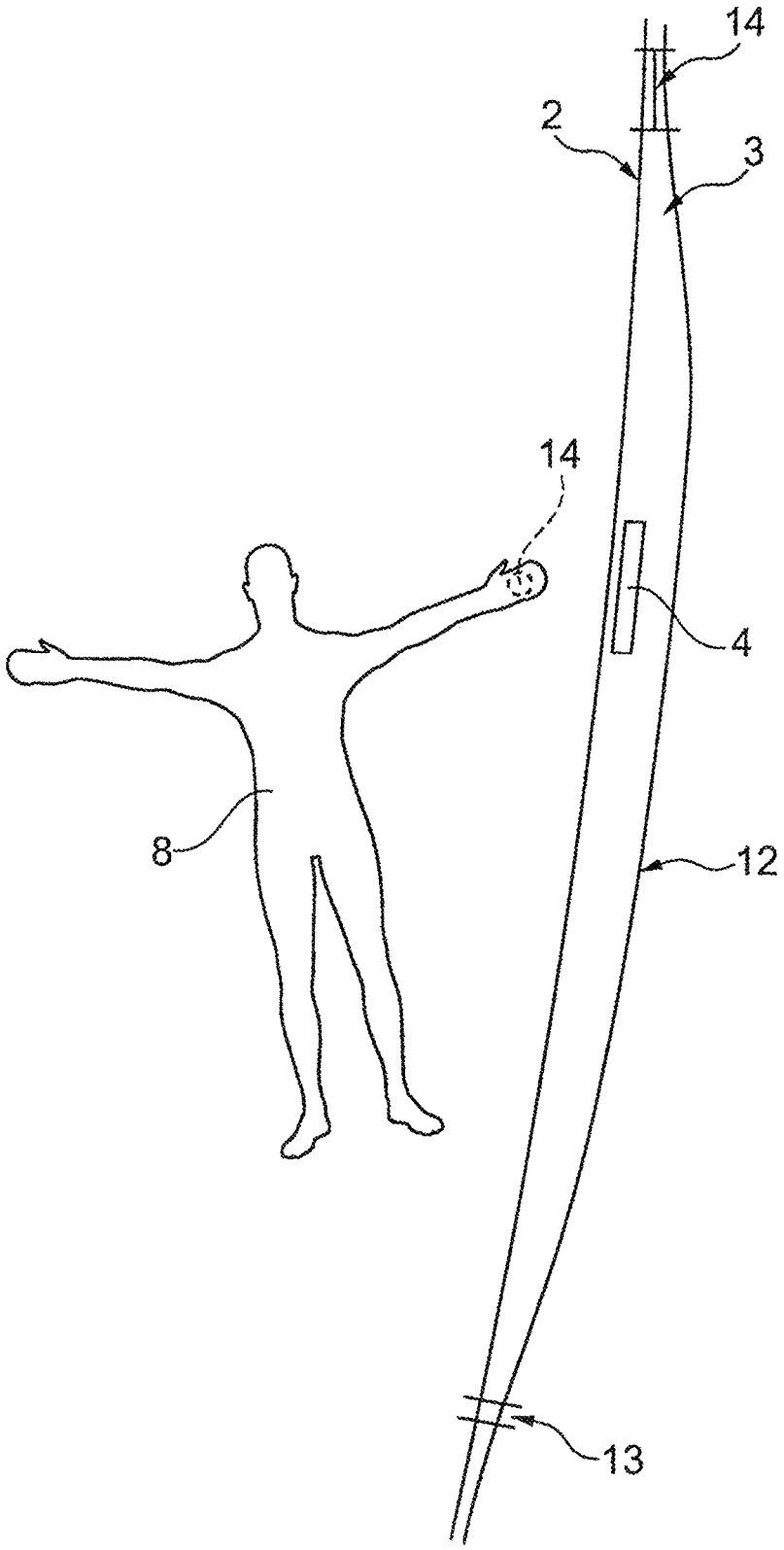
FIG. 2 shows a schematic section through the pocket of the garment according to FIG. 1.

A schematic section through the pocket 3 is illustrated in FIG. 2. To form the pocket 3, a further layer of material 12 has been attached on the rear side of the play surface 2. In the lower region of the pocket 3, the layer of material 12 is joined to the rear side of the play surface 2 via a fixed connection 13, in that the two are sewn together. In the upper region, in turn, the two layers are joined detachably together via a hook-and-loop fastener 14, such that the moving element 4 can also be removed before washing. Furthermore, a play figure 8 is provided, which has already been illustrated in FIG. 1 and sticks to the moving element 4 with one extremity, in which a magnet 14 is in turn implemented. Toward the outside, however, this occurs "invisibly" since neither the magnet 14 nor the moving element 4 as magnetizable body are visible toward the outside. Depending on how great the friction forces are, the moving element 4 can also drop down within the pocket 3 under the force of gravity. Since the moving element 4 is not visible from the outside, it is possible, for better findability, for the pocket, for example, also to be designed in a triangular manner (with the tip downward) in the lower region at the seam 13, such that the moving element 4 slips down to the deepest point of the pocket under its own weight without any other force application and can easily be found there from the outside.

Figure 3:
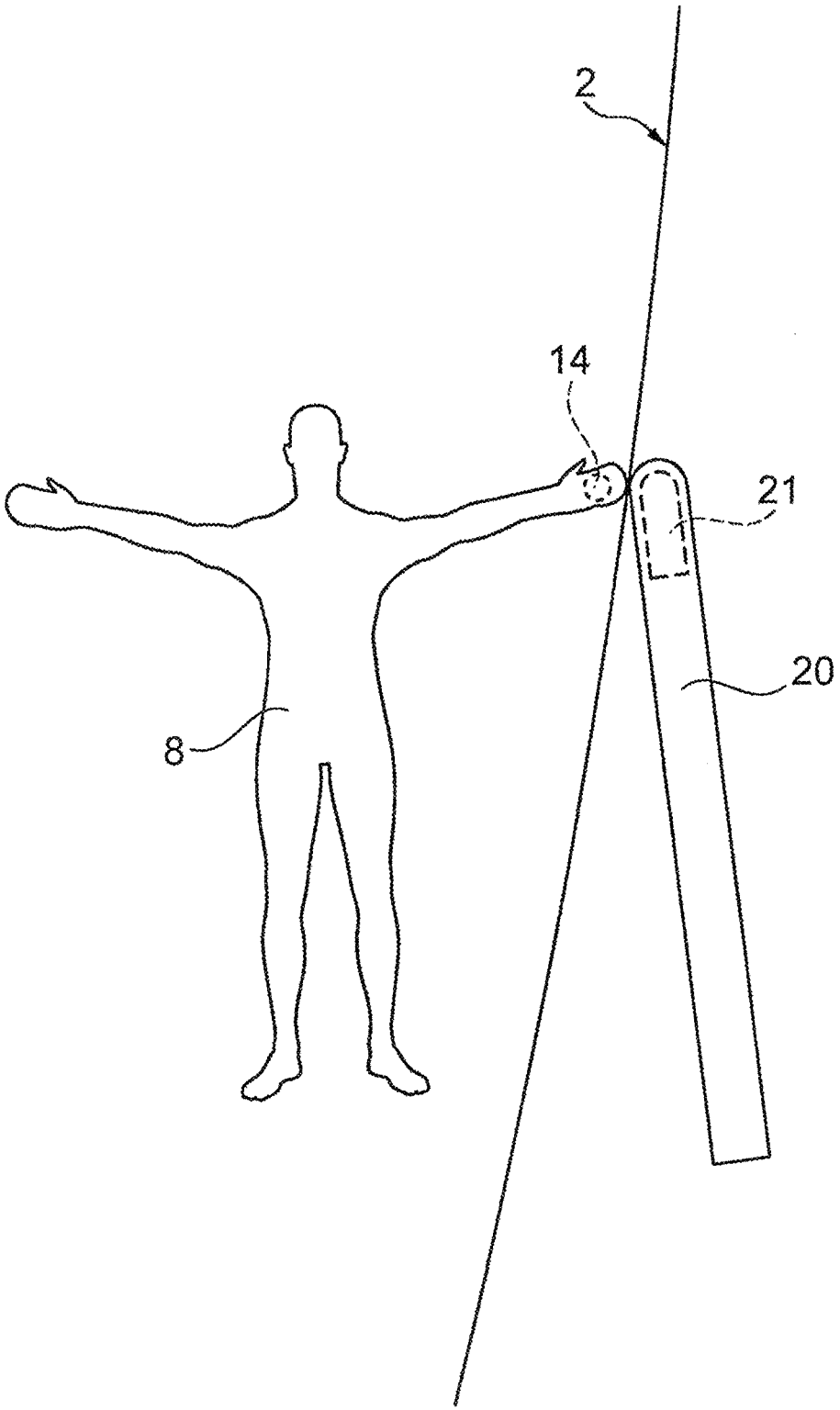
FIG. 3 shows a schematic illustration of a part of a play device according to the present invention.

In order to be able to improve the play possibilities even further, a play device according to FIG. 3 can be provided. FIG. 3 shows an expansion possibility in which the play figure 8 is retained on the surface 2, but not in the region of the pocket 3 or via a moving element 4, but via a separate rod 20, in the interior of which a magnet or a magnetizable body 21 is likewise located. The play figure 8 can thus, in the same way as in FIG. 2, be held or moved. In this expansion possibility according to FIG. 3, the play figure 8 is guided via a separate rod, however, which is moved, for example, by the wearer of the garment.

Figure 4:
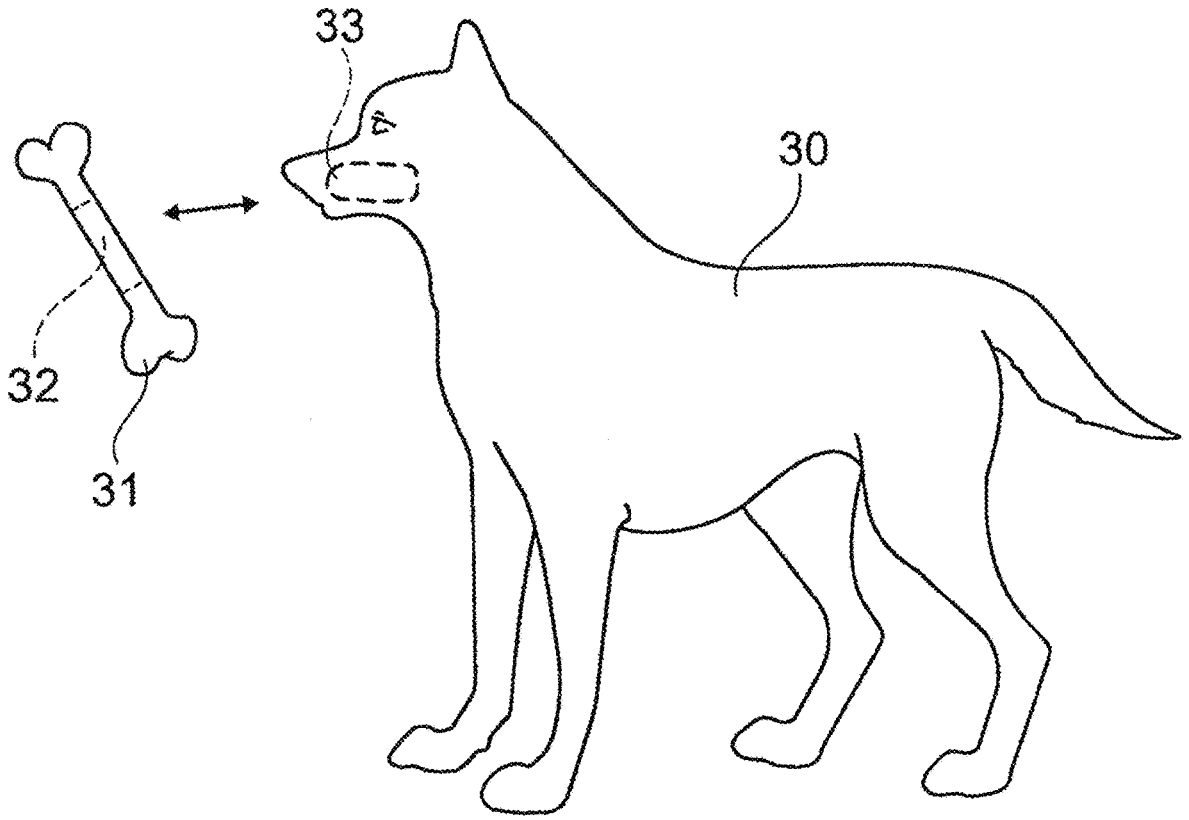
FIG. 4 shows a schematic illustration of a play figure for use in conjunction with the present invention.

FIG. 4 in turn illustrates an expansion possibility which relates to a play FIG. 30. Provided as a supplement to this play FIG. 30 (in the form of a dog here) is a play FIG. 31 in the form of a chewing bone. A magnetizable body or a magnet 32 have been introduced into the bone 31; likewise, a magnet or a magnetizable body 33 is located correspondingly in the play FIG. 30. As a result of the attraction force between the two play FIGS. 30 and 31, not only are the play figures attracted to one another, but the play FIG. 31 in the form of a bone passes directly into the region of the muzzle of the play FIG. 30 and thus gives the effect of the bone 31 being snatched by the dog 30.

Figure 5:
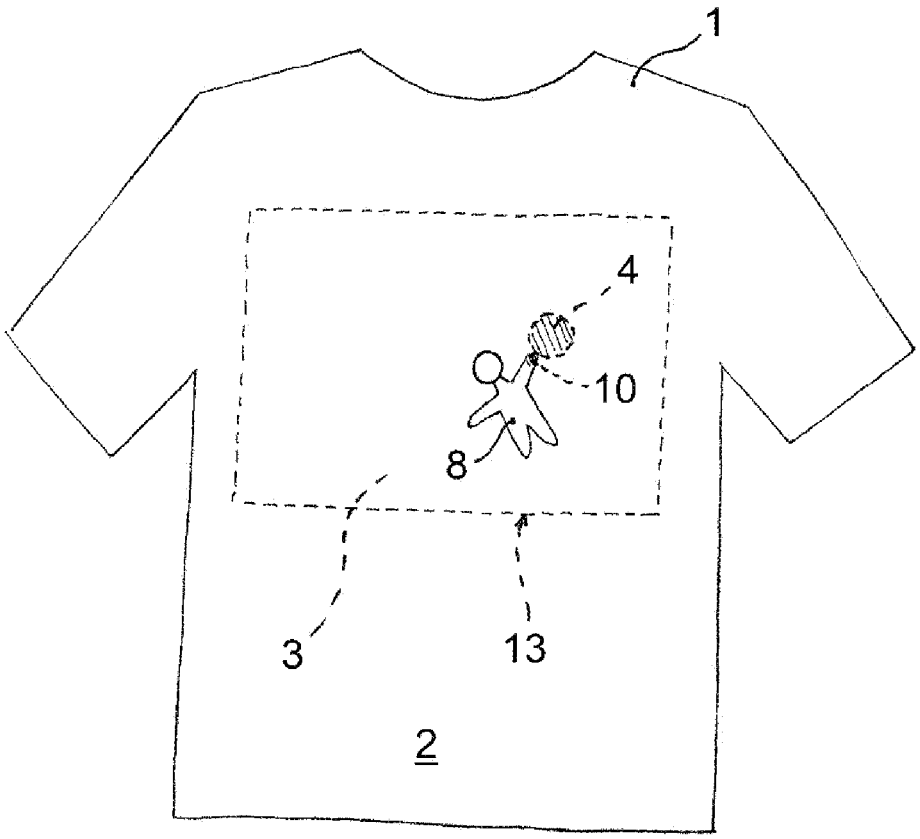
FIG. 5 shows a schematic illustration of a garment according to another aspect of the present invention.

FIG. 5 shows a garment 1, for example a pullover or a T-shirt with a play surface 2 on its front side where a pocket 3 is formed. A second sheet of fabric is sewed and completely closed along its circumference 13. Before it is closed, a magnet 4 is put inside. The size of the pocket 3 is roughly 30% of the entire surface respectively the play surface 2 of the garment 1 on its front side.

A play figure 8 can attach to the magnet 4 via a magnetizable body 10 provided in a part of the play figure 8, for example, in one of its extremities, namely one of the arms, more precisely, in its hand, so that the play figure 8 looks like it is hanging on the garment 1 like a rock climber. The play figure 8 can be moved in this state, hanging on the garment 1, over the range of the pocket 3 within the limits of the seam 13.

Figure 6:
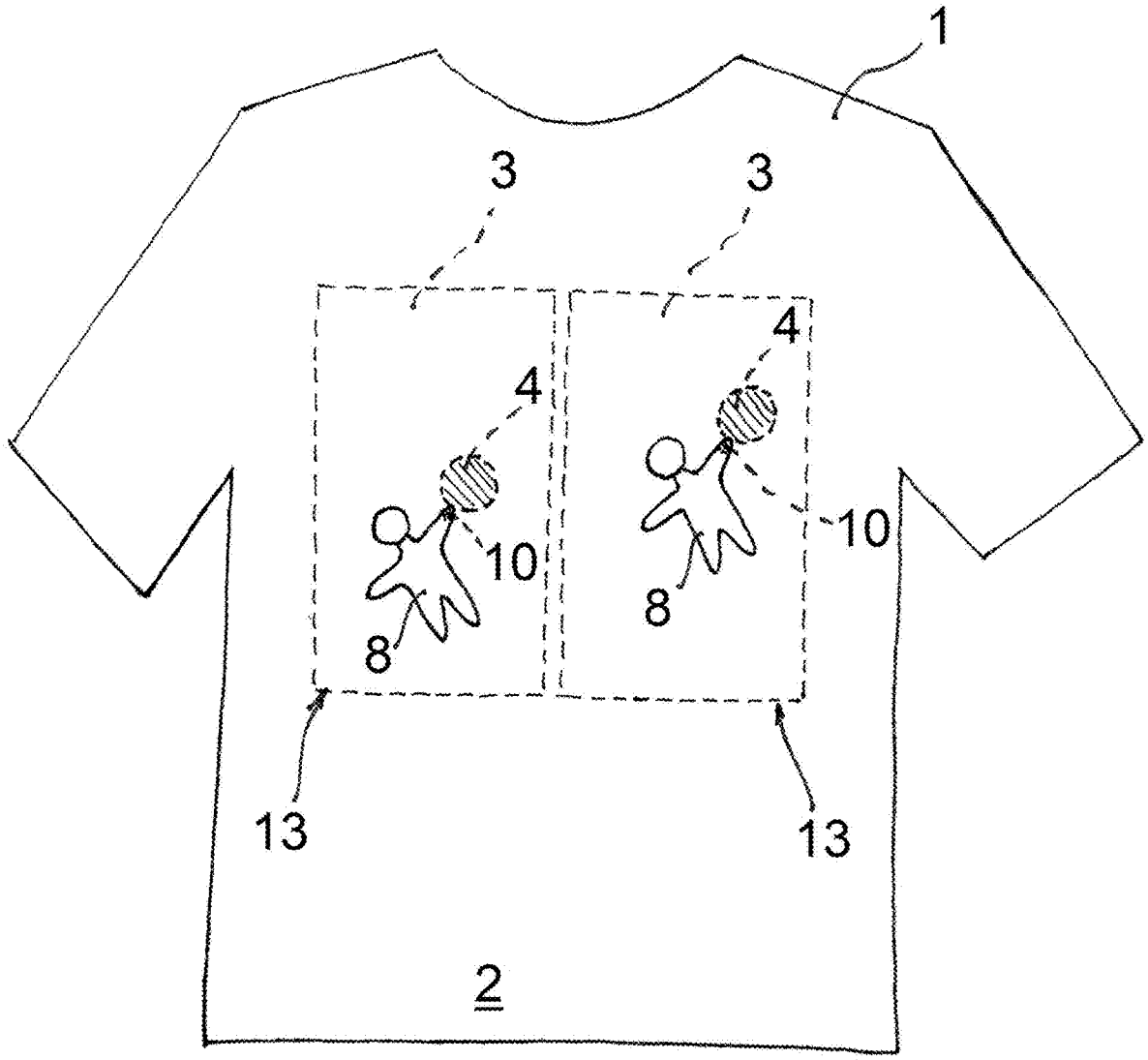
FIG. 6 shows a schematic illustration of a garment according to another aspect of the present invention.

A similar embodiment is shown in FIG. 6, but the pocket 3 is split in two parts, where each part 3 is closed entirely by a circumferential seam 13 and the two parts 3 are not connected to each other. Hence, when the play figures 8 are attached to different magnets 4 in different pockets 4, respectively, they can be moved over two different, non-overlapping areas.

Figure 7:
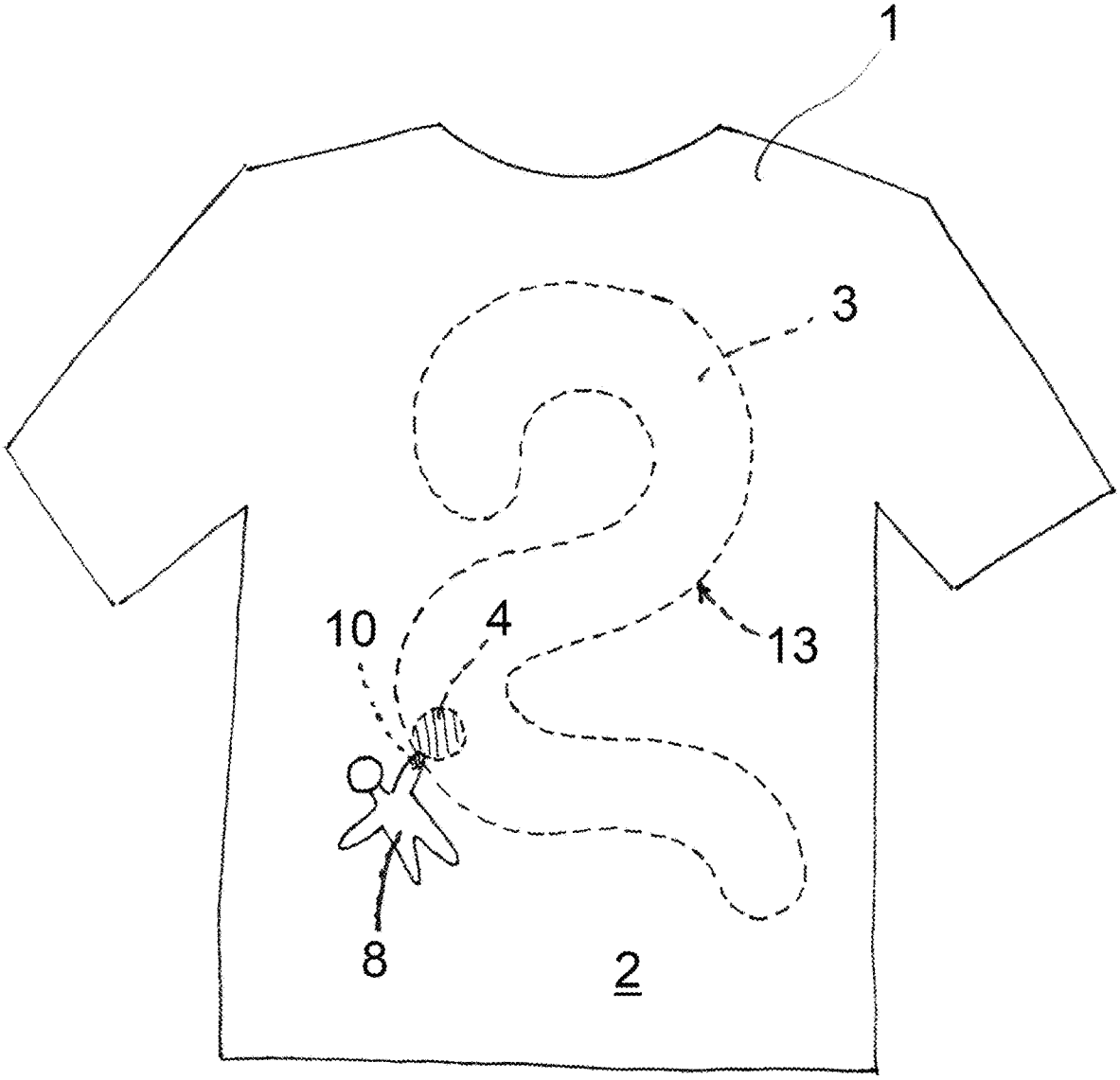
FIG. 7 shows a schematic illustration of a garment according to another aspect of the present invention.
Figure 8:
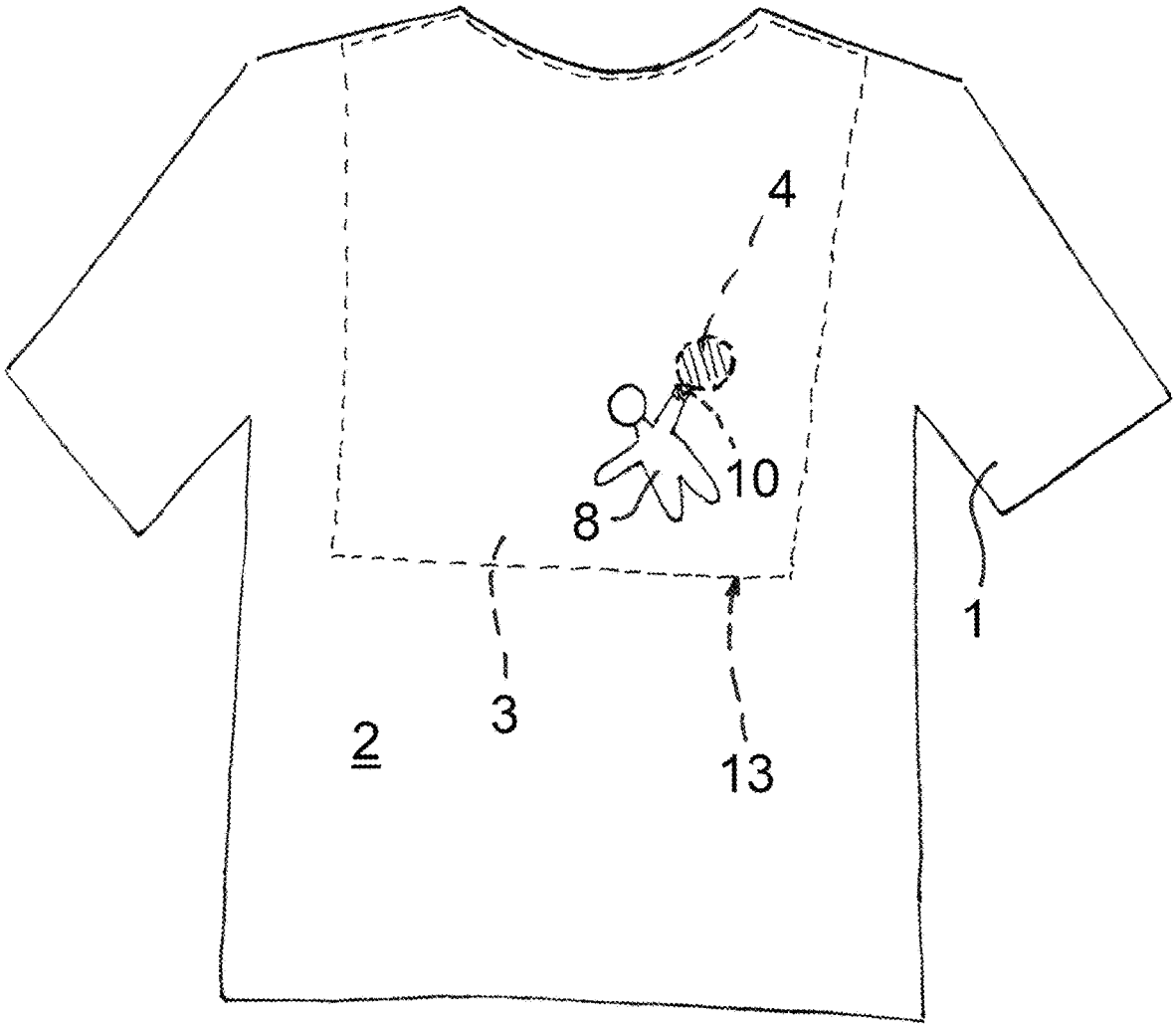
FIG. 8 shows a schematic illustration of a garment according to another aspect of the present invention.

The embodiment of FIG. 7 is similar to the embodiment of FIG. 5, but the pocket 3 is defined as a curved area. The width of the curved area 3 is at least two times the diameter of the magnet 4, whereas its length is much larger.

Another difference shown in the embodiment of FIG. 8 is the fact that the pocket 3 extents to the upper edge or seam of the garment 1 at the shoulders and the neckline. It is therefore possible to use the same seam at this line from shoulder to shoulder.

Figure 9:
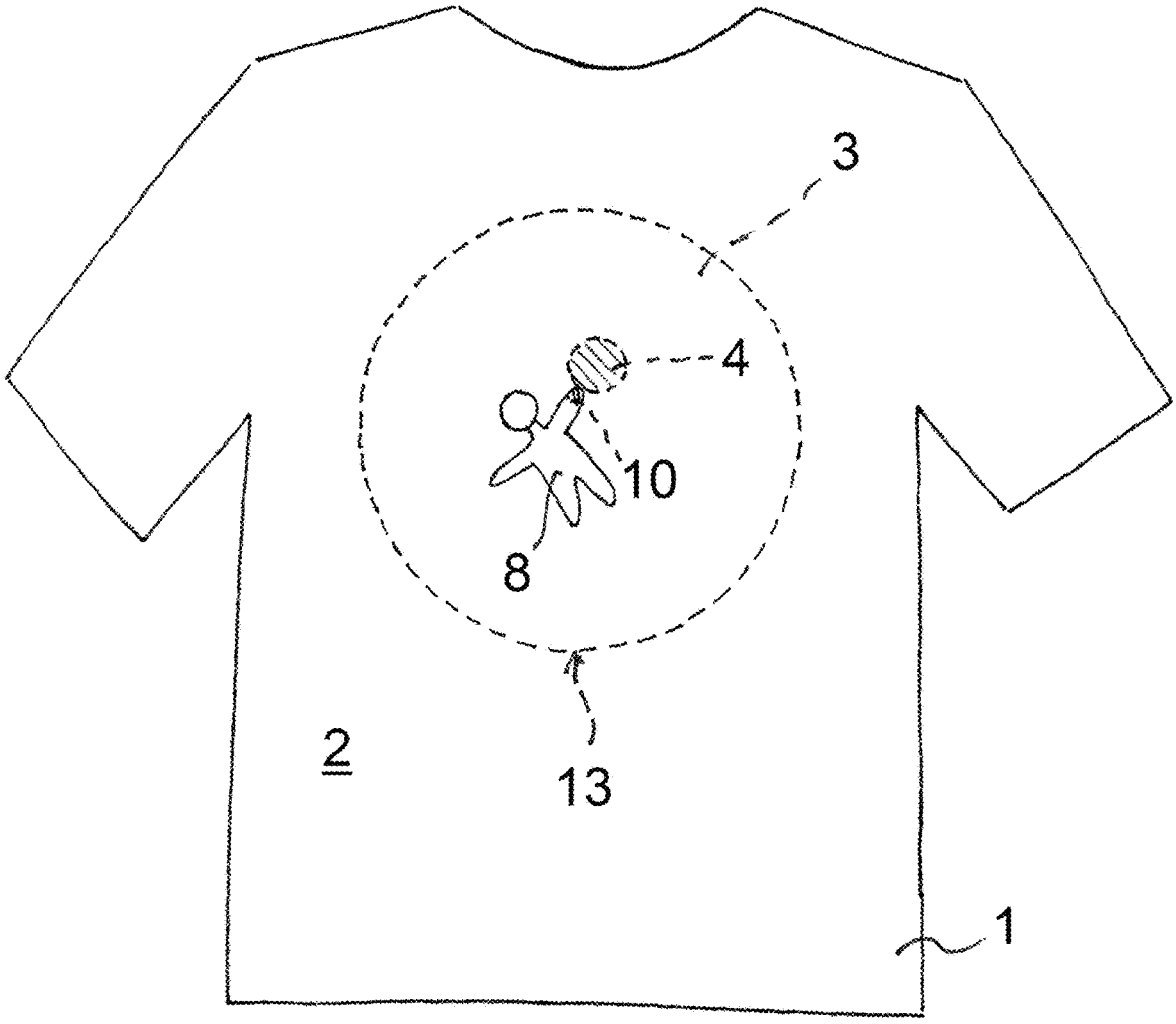
FIG. 9 shows a schematic illustration of a garment according to another aspect of the present invention.

In the embodiment shown in FIG. 9, the pocket 3 is circular with a circular seam 13. Here, the diameter of the pocket 3 is also much bigger than the diameter of the magnet 4, for example, more than 8 times larger.

Figure 10A:
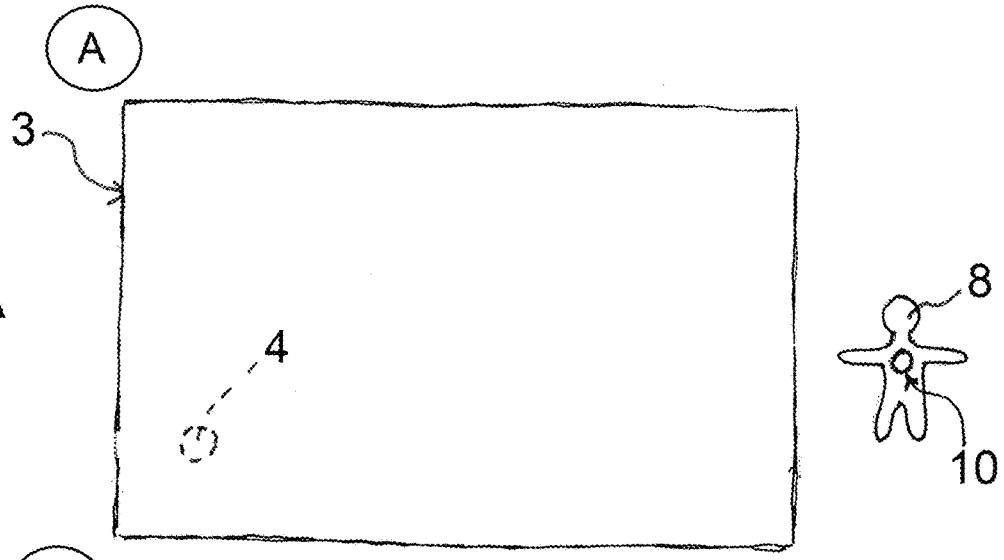
FIGS. 10A-10C schematically show a method of manipulating (playing) with the play figure of the garment according to the present invention.
Figure 10B:
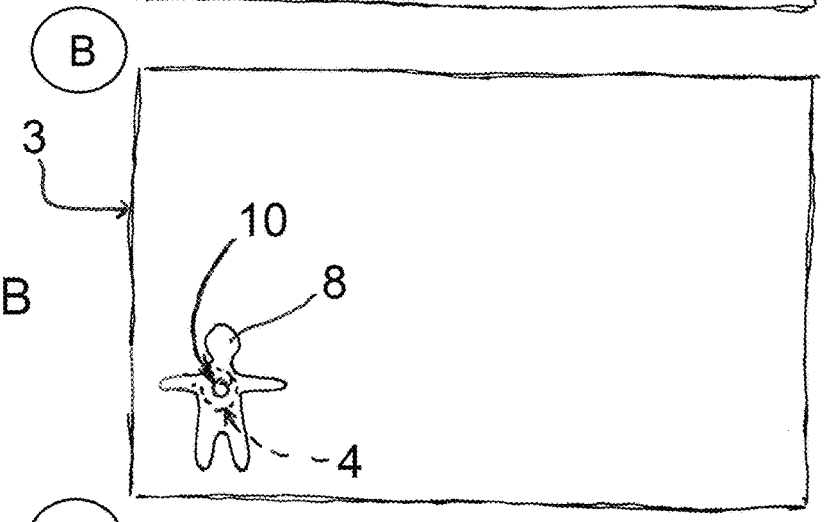
Figure 10C:
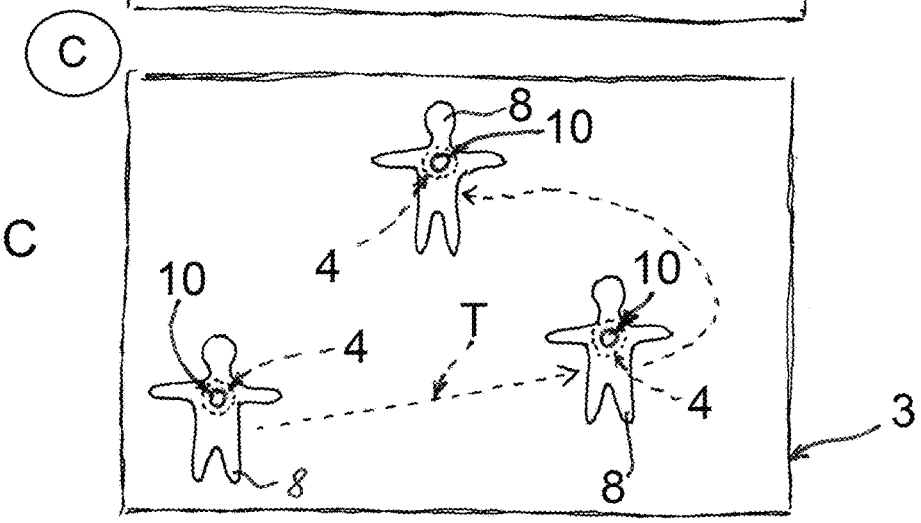

FIGS. 10A-10C show a method of how to manipulate (play) with the play figure 8, including Steps A-C.

Step A (FIG. 10A):

A pocket 3 is presented with a movable magnet 4 inside. The pocket 3 can be retrofitted to a suitable garment or can already be part of a garment. Furthermore, the play figure 8 with a different, non-movable magnetizable body incorporated therein is provided.

Step B (FIG. 10B):

The play figure 8 at is put a position corresponding to where the movable magnet 4 is, and the play figure 8 is attached at that position due to the magnetic force between the movable magnet 4 and the non-movable magnetizable body 10, and due to the friction of those two bodies with the fabric between them, so that the play figure 8 stays at this position.

Step C (FIG. 10C):

It is also possible to move the play figure 8 by hand across the surface of the pocket 3, here along trace T. Due to the attraction force between the movable magnet 4 and the non-movable magnetizable body 10 fixed inside the play figure 8, the movable magnet 4 automatically follows the play figure 8, i.e. the non-movable magnet or magnetizable body 10. Here the magnet 4 and its magnetic force and the friction between the three materials can be chosen in such a way that the friction is not too high to inhibit the collective movement of the play figure 8 and the magnet 4, but when you release the play FIG. 4, it stays again in this position, fixed to the magnet 4 in the pocket that has followed to this position.

The magnet 4 can, in principle, also be fixed in the play figure 8, and the magnetizable body 10 can also be in the pocket 3 in such a case.

All the exemplary embodiments and developments of the present invention have in common that a play figure and a movable fastening device are provided, wherein the movable fastening device can be joined to or integrated in the garment and is movable relative to the garment or the play surface. The movable fastening device can also have a movable mounted moving element. The play figure can be fastened detachably to the movable fastening device and/or to the moving element of the movable fastening device. The garment thus forms a part of a three-dimensional play landscape, in which play figures are movable in three dimensions in the region of the garment.

REFERENCE SIGNS

1 Garment
2 Play surface
3 Pocket

4 Moving element
5 Pendulum
6 Hook-and-loop fastener
7 Play FIG.
8 Play FIG.
9 Guide rail
10 Magnet/magnetizable body
11 Play FIG.
12 Layer of material
13 Firm connection/seam
14 Hook-and-loop fastener
15 Hook-and-loop fastener at the pocket periphery
20 Rod
21 Magnet/magnetizable body
30 Play FIG.
31 Play FIG.
32 Magnet/magnetizable body
33 Magnet/magnetizable body

The invention claimed is:

1. A garment comprising:
a play surface;
at least one play figure; and
a movable fastening device,
wherein the at least one play figure and the movable fastening device are provided on the play surface,
wherein the movable fastening device is at least one of
(i) connected to the garment, and
(ii) integrated with the garment,
wherein the movable fastening device has a moving element that is mounted in a movable manner relative to at least one of
(iii) the garment, and
(iv) the play surface,
wherein the movable fastening device has a fixed part,
wherein the at least one play figure is detachably fastened to at least one of
(v) the movable fastening device, and
(vi) the moving element,
wherein at least one of the at least one play figure is magnetically fastened to at least one of
(vii) the movable fastening device, and
(viii) the moving element,
wherein the movable fastening device is configured as a pocket that is integrated in the play surface and forms an interior space inside which the moving element is movably mounted,
wherein the pocket extends over a two-dimensional plane of the play surface and covers at least 5% of an area of the play surface,
wherein the moving element is at least one of
(ix) a magnet, and
(x) a magnetizable body, and
wherein the at least one of a non-movable magnet and a non-movable magnetizable body is implemented into a body of the play figure and fixed thereon/thereto so that the non-movable magnet or non-movable magnetizable body cannot be moved with respect to the body of the play figure, and
wherein the movable fastening device is partially movable relative to at least one of the garment and the play surface, and
wherein a length and a width of the pocket is at least two times a maximum dimension of the moving element to provide an elongate movement path for the at least one play figure so that the at least one play figure may move fluidly along the path relative to the play surface of the pocket.

2. The garment as claimed in claim 1, wherein another one of the at least one play figure is fastened to at least one of the movable fastening device and the moving element via at least one of
(xi) a clamp, and
(xii) a hook-and-loop fastener.

3. The garment as claimed in claim 1, wherein the movable fastening device is configured as at least one of
(xiii) a pendulum fastened to the play surface at least at one point and/or along at least a part of a length of the pendulum, and
(xiv) a guide rail having a runner that is mounted in the guide rail, wherein the runner comprises the moving element.

4. The garment as claimed in claim 1, wherein the pocket has an extension that is substantially parallel to the play surface, and the extension perpendicular to the play surface in a direction that corresponds to a height of the moving element.

5. The garment as claimed in claim 1, wherein the interior space of the pocket is configured to be openable and reclosable in a subregion of periphery of the pocket, to allow a possibility of at least one of
removing the movable element,
inserting the movable element, and
replacing the moving element.

6. The garment as claimed in claim 1, wherein the interior space of the pocket has a tunnel, and
wherein a width of the tunnel parallel to the play surface corresponds to a width of the moving element, such that the moving element is mounted in the tunnel and is movable along a length of the tunnel.

7. The garment as claimed in claim 1, further comprising at least one static fastening mechanism.

8. The garment as claimed in claim 7, wherein the at least one static fastening mechanism is configured as at least one of
(xv) a hook-and-loop fastener,
(xvi) a magnet,
(xvii) a magnetizable body, and
(xviii) a press button.

9. The garment as claimed in claim 1, wherein the pocket has first and second opposing sides, and
wherein the first side is formed or bounded by a material defining the play surface, and the second opposing side is defined by a piece of textile fastened to the play surface.

10. The garment as claimed in claim 1, wherein the garment is formed at least partially by two textile material layers, and the pocket is arranged between the two textile material layers and delimited by a fastening of the two textile material layers in a peripheral region of the pocket.

11. A play device for children, the play device comprising:
a garment as claimed in claim 1; and
a rod that has a magnet and/or a magnetizable body,
wherein the play figure of the garment is at least one play figure,
wherein the at least one play figure has a magnet and/or a magnetizable body,
wherein the rod is detachably connectable to the garment in order to keep the at least one play figure attached on the garment, and to be able to move the at least one play figure over the play surface by magnetic force between the at least one play figure and the rod, and
wherein a part of the play surface of the garment is disposed between the at least one play figure and the rod.

12. The garment as claimed in claim 7, wherein the at least one static fastening mechanism comprises at least three static fastening mechanisms that are arranged alongside one another such that the three static fastening mechanisms form a substantially continuous line or path.

13. The garment as claimed in claim 1, wherein the pocket covers at least 10% of the area of the play surface.

14. The garment as claimed in claim 1, wherein the pocket extends over a front of the play surface.

15. The garment as claimed in claim 1, wherein the moving element is coated with a chemically inert, waterproof coating.

16. The garment as claimed in claim 1, wherein the moving element is shaped as a disk.

17. The garment as claimed in claim 16, wherein the disk has a round peripheral shape that defines a cylinder having flat principle surfaces.

18. The garment as claimed in claim 1, wherein the at least one of the non-movable magnet and the non-movable magnetizable body of the play figure is fixed at an extremity part of the play figure body.

19. The garment as claimed in claim 1, wherein the pocket forms a portion of an edge of the play surface.

20. The garment as claimed in claim 1, wherein the pocket is completely closed so that the moving element located within the pocket cannot be removed.

21. The garment as claimed in claim 20, wherein the pocket is completely closed via at least one of a sewn closure, a glued closure, and a mechanically fastened closure.

22. The garment as claimed in claim 1, wherein the pocket has a length dimension and a width dimension, wherein the length dimension of the pocket is at least two times greater than a maximum dimension of the moving element, and wherein the width dimension of the pocket is at least 4 times greater than the maximum dimension of the moving element.

23. The garment as claimed in claim 22, wherein the width dimension of the pocket is at least 3 times greater than the maximum dimension of the moving element, and wherein the length dimension of the pocket is at least 5 times greater than the maximum dimension of the moving element.

* * * * *